US010507678B2

(12) United States Patent
Shinjo

(10) Patent No.: US 10,507,678 B2
(45) Date of Patent: Dec. 17, 2019

(54) PRINTING APPARATUS

(71) Applicant: CANON KABUSHIKI KAISHA, Tokyo (JP)

(72) Inventor: Ryoya Shinjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/964,093

(22) Filed: Apr. 27, 2018

(65) Prior Publication Data

US 2018/0326764 A1 Nov. 15, 2018

(30) Foreign Application Priority Data

May 12, 2017 (JP) ..... 2017-096005

(51) Int. Cl.

| | |
|---|---|
| ***B41J 15/04*** | (2006.01) |
| ***B41J 11/42*** | (2006.01) |
| ***B41J 11/70*** | (2006.01) |
| ***B41J 11/00*** | (2006.01) |
| ***B41J 11/66*** | (2006.01) |

(52) U.S. Cl.

CPC ..... *B41J 15/04* (2013.01); *B41J 11/0085* (2013.01); *B41J 11/0095* (2013.01); *B41J 11/42* (2013.01); *B41J 11/66* (2013.01); *B41J 11/70* (2013.01)

(58) Field of Classification Search

CPC ..... B41J 11/66; B41J 11/70

See application file for complete search history.

(56) References Cited

U.S. PATENT DOCUMENTS

| | | | |
|---|---|---|---|
| 6,249,301 | B1 | 6/2001 | Kawamura et al. |
| 8,277,039 | B2 | 10/2012 | Nakamaki et al. |
| 8,659,789 | B2 | 2/2014 | Iwata et al. |
| 8,858,105 | B2 | 10/2014 | Sugimura |
| 9,334,137 | B2 | 5/2016 | Igarashi et al. |
| 9,539,831 | B2 | 1/2017 | Tanami et al. |
| 9,579,907 | B2 | 2/2017 | Shinjo et al. |
| 9,969,192 | B2 | 5/2018 | Suzuki et al. |
| 10,220,641 | B2 | 3/2019 | Wakamatsu |
| 2013/0149019 | A1 | 6/2013 | Sugimura |
| 2013/0242316 | A1 | 9/2013 | Iwata et al. |
| 2016/0039226 | A1 | 2/2016 | Oida et al. |
| 2016/0136981 | A1 | 5/2016 | Suzuki et al. |
| 2016/0207333 | A1 | 7/2016 | Igarashi et al. |

(Continued)

FOREIGN PATENT DOCUMENTS

| | | |
|---|---|---|
| JP | 2001-088385 A | 4/2001 |
| JP | 2003-054054 A | 2/2003 |

(Continued)

OTHER PUBLICATIONS

U.S. Appl. No. 15/902,509, Takahiro Daikoku Masashi Kamada Masato Eiyama Yuki Igarashi Masashi Negishi Ryoya Shinjo Ryo Kobayashi Tomohiro Suzuki, filed Feb. 22, 2018.

(Continued)

*Primary Examiner* — Julian D Huffman

(74) *Attorney, Agent, or Firm* — Venable LLP

(57) ABSTRACT

A continuous sheet is conveyed in a first direction in a printing operation, cut with a cutter in a cutting operation, and then conveyed in a second direction opposite to the first direction. A conveyance amount of the continuous sheet in the second direction is changed based on an operation of the printing apparatus after the cutting operation.

13 Claims, 16 Drawing Sheets

(56) References Cited

U.S. PATENT DOCUMENTS

| | | | | |
|---|---|---|---|---|
| 2017/0072718 | A1 | 3/2017 | Watanabe | |
| 2017/0266999 | A1* | 9/2017 | Hamano | B41J 11/70 |
| 2018/0093508 | A1* | 4/2018 | Uno | B41J 11/007 |

FOREIGN PATENT DOCUMENTS

| | | | |
|---|---|---|---|
| JP | 2006-095718 | A | 4/2006 |
| JP | 2006-341433 | A | 12/2006 |
| JP | 2009-234013 | A | 10/2009 |
| JP | 2013-121672 | A | 6/2013 |
| JP | 2013-188937 | A | 9/2013 |
| JP | 2014-151601 | A | 8/2014 |
| JP | 2016-037043 | A | 3/2016 |
| JP | 2016-104554 | A | 6/2016 |

OTHER PUBLICATIONS

U.S. Appl. No. 15/903,493, Shuichi Masuda Masashi Kamada Masato Eiyama Yuki Igarashi Masashi Negishi Ryoya Shinjo Ryo Kobayashi Tomohiro Suzuki, filed Feb. 23, 2018.

U.S. Appl. No. 15/906,146, Masato Eiyama Yuki Igarashi Masashi Kamada Masashi Negishi Ryoya Shinjo Ryo Kobayashi Tomohiro Suzuki Tsutomu Obata, filed Feb. 27, 2018.

U.S. Appl. No. 15/910,489, Tomohiro Suzuki Masashi Kamada Masato Eiyama Yuki Igarashi Masashi Negishi Ryoya Shinjo Ryo Kobayashi, filed Mar. 2, 2018.

U.S. Appl. No. 15/912,592, Midori Yasuda Yuki Kamio Masashi Kamada Masato Eiyama Yuki Igarashi Masashi Negishi Ryoya Shinjo Ryo Kobayashi Tomohiro Suzuki, filed Mar. 6, 2018.

U.S. Appl. No. 15/912,869, Masato Eiyama Masashi Kamada Yuki Igarashi Masashi Negishi Ryoya Shinjo Ryo Kobayashi Tomohiro Suzuki, filed Mar. 6, 2018.

Extended European Search Report dated Oct. 4, 2018, in European Patent Application No. 18170420.6.

Notification of Reasons for Refusal dated Apr. 2, 2019, in Japanese Patent Application No. 2017-096005.

Office Action dated Oct. 29, 2019, issued in Japanese Patent Application No. 2017-096005.

* cited by examiner

PRINTING APPARATUS

BACKGROUND OF THE INVENTION

Field of the Invention

The present invention relates to a printing apparatus which prints an image on a continuous sheet.

Description of the Related Art

There is a printing apparatus which performs printing processing for a continuous sheet such as a roll sheet (hereinafter referred to as "continuous sheet" or simply "sheet") accompanied by a cutting operation for each image. For example, Japanese Patent Laid-Open No. 2016-104554 discloses a printing apparatus comprising a conveying roller which conveys a sheet, a platen which sucks a sheet on the platen to prevent it from floating, a print head which ejects ink toward a sheet on the platen to perform printing, and a cutter which cuts a sheet.

In a conveying mechanism which conveys a sheet while nipping it with conveying rollers, in the case of a long standby time until the start of printing, part of the sheet nipped with the conveying rollers for a long time may be curved (warped) and this may affect the quality of a printed image (image quality). For example, if the type of sheet is glossy paper, there is a possibility that an ink accepting layer on a surface is curved (warped) and gloss unevenness occurs.

To solve the above problem, in Japanese Patent Laid-Open No. 2016-104554, conveyance is controlled so that part of a sheet nipped during a standby time until the start of image printing becomes a margin outside an image print area. More specifically, a sheet on which an image has been printed is conveyed in a conveying direction (forward direction) and the rear end of the printed image is cut with the cutter to separate the printed product from a continuous sheet. After that, the rest of the sheet positioned at an upstream side in the conveying direction is pulled in a direction (backward direction) opposite to the conveying direction so that a front end newly created by the cutting is in a predetermined position. In the case of printing the next image on the sheet, a print operation is started after the sheet is conveyed by a predetermined amount in the conveying direction so that the front end of the sheet is in a print start position.

SUMMARY OF THE INVENTION

However, in the sheet conveyance control described above, the sheet is conveyed in both the conveying direction and the direction opposite to the conveying direction to move the front end of the sheet from the cutting position to the print start position. This reversal of the conveying direction takes a long time until the end of printing in the case of consecutively printing a plurality of images.

The present invention provides a printing apparatus capable of increasing throughput in the case of printing a plurality of images on a continuous sheet consecutively or within a predetermined time.

In the present invention, there is provided a printing apparatus comprising:

a printing unit configured to perform a printing operation for printing an image on a continuous sheet;

a conveying unit configured to convey the continuous sheet in a first direction, which is a conveyance direction in the printing operation, and a second direction opposite to the first direction;

a cutting unit provided downstream of the printing unit in the first direction and configured to perform a cutting operation for cutting the continuous sheet; and a control unit configured to cause the conveying unit to convey the continuous sheet in the second direction after the cutting operation, wherein the control unit changes a conveyance amount of the continuous sheet in the second direction based on an operation state of the printing apparatus after the cutting operation.

Further features of the present invention will become apparent from the following description of exemplary embodiments with reference to the attached drawings.

DESCRIPTION OF THE EMBODIMENTS

The present invention is applicable to various types of image forming apparatuses such as a printing apparatus, copying machine, and facsimile machine. As an image forming apparatus to which the present invention is applicable, an inkjet printing apparatus (hereinafter also simply referred to as a printing apparatus) is used to describe the embodiments of the present invention with reference to the drawings.

First Embodiment (Printing Apparatus)

Figure 1:
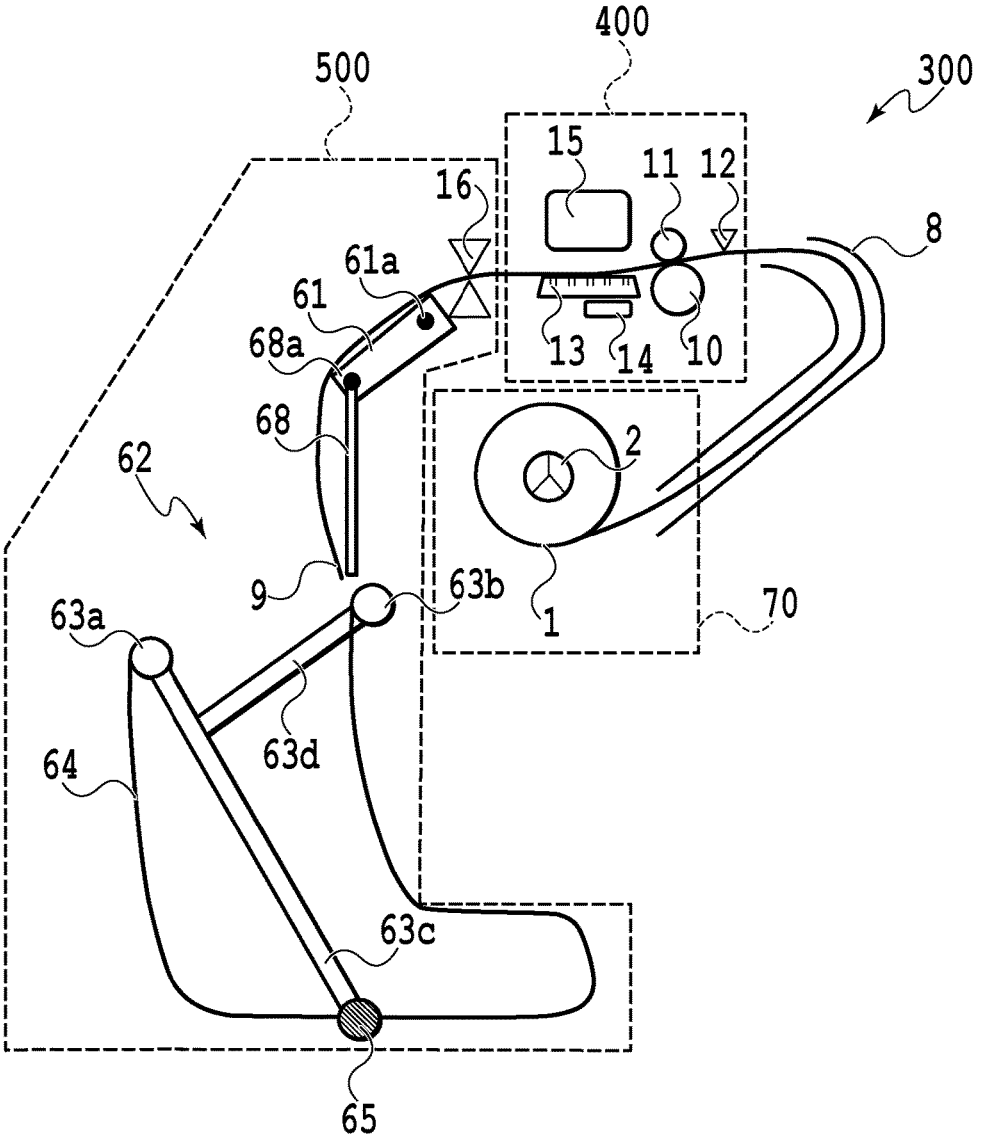
FIG. 1 is a diagram showing a configuration of a printing apparatus according to an embodiment of the present invention.

A printing apparatus shown in FIG. 1 has a feeding unit 70 (feeding unit), a sheet conveying unit 300, a printing unit 400 (printing unit), and a sheet discharging unit 500. A sheet 1, which is an elongate continuous sheet wound in a roll, is used as a print medium and is attached to the feeding unit 70. In this specification, a continuous sheet wound in a roll is also referred to as a roll sheet.

The feeding unit 70 has the function of pulling a sheet from a rolled part of the roll sheet 1 attached (set) to the feeding unit 70 and feeding the sheet.

In FIG. 1, a spur member (roll member) 2 is pivotally supported by a holding unit of the feeding unit 70 while being inserted into a paper tube of the roll sheet 1. A roll driving motor (driving unit; not shown) applies a rotational force to the spur member 2 pivotally supported by the holding unit of the feeding unit 70, whereby the spur member 2 can rotate in both forward and backward directions. A conveying guide 8 guides the sheet 1 fed from the feeding unit 70 to the printing unit 400 while contacting both sides of the sheet 1.

A conveying roller 10 is rotated in both the forward and backward directions by a conveying roller driving motor. A pinch roller 11 rotates following the rotation of the conveying roller 10. The conveying roller 10 has the function of nipping (pinching) and conveying the sheet together with the pinch roller 11.

A sheet front end detection sensor 12 detects a front end of the sheet 1 fed from the feeding unit 70. The detection of the front end of the sheet 1 triggers driving of the roll driving motor (driving unit) and conveying roller driving motor described above and is also used to detect a paper jam (jam). A platen 13 (suction platen) supports the sheet 1 from the bottom, guides the sheet 1, and sucks the back of the sheet 1 by using a negative pressure produced by a platen fan 14 (suction fan) so that printing is performed by a print head 15 with high accuracy.

The printing unit 400 has the print head 15 which ejects ink toward the sheet to print an image. The print head 15 has a nozzle surface (ejection opening forming surface) on which nozzles (ejection openings) capable of ejecting ink droplets are formed. Ink is supplied to the print head 15 from an ink tank which stores ink. The printing unit 400 has a carriage on which the print head 15 is detachably mounted and which can move reciprocally in directions crossing a conveying direction of the sheet (i.e., the width directions of the sheet). The print head 15 prints an image on the sheet by ejecting ink droplets from the nozzles during the movement of the carriage. An image is printed on the sheet (i.e., a printing operation is performed) by alternately repeating the conveyance of the sheet by a predetermined amount performed by the conveying roller 10 (intermittent conveyance) and the ink ejection performed by the print head 15 while the conveyance of the sheet is stopped (image forming).

After printing, the sheet discharging unit 500 cuts the sheet 1 with a cutter 16 and stores the sheet on which an image has been printed in a basket unit 62 (housing apparatus, housing unit).

A sheet discharging guide 61 guides the back of the sheet 1 on which an image has been printed. The sheet discharging guide 61 can turn around an axis 61*a*. In the case of attaching the roll sheet 1 to the feeding unit 70, the sheet discharging guide 61 turns clockwise around the axis 61*a* from the state shown in FIG. 1 to provide a space in the front of the printing apparatus (the left side in FIG. 1). The roll sheet 1 can be attached through the space.

The basket unit 62 includes rods 63*a* to 63*d* as a structure (skeleton) and a flexible bag-shaped cloth 64 which houses the discharged sheet 1. The basket unit 62 can turn around an axis 65 and can be stored at the bottom of the printing apparatus body.

(Configuration for Setting Roll Sheet)

Figure 3A:
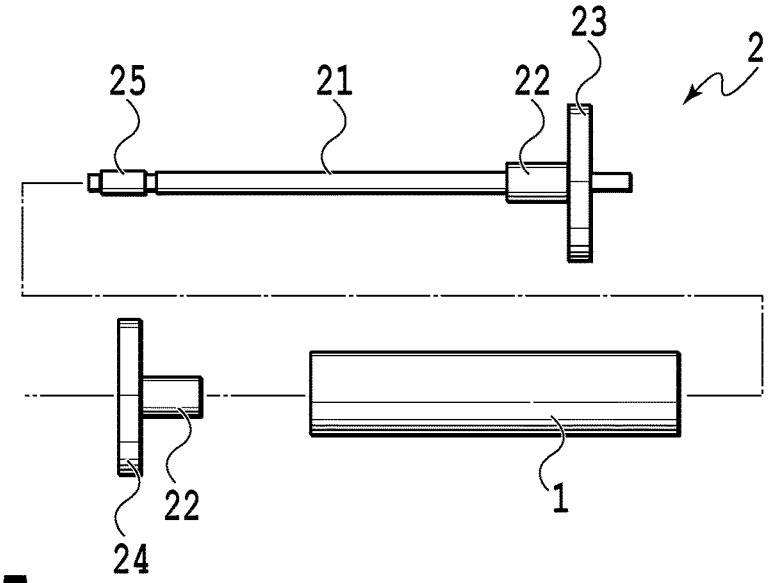
FIG. 3A to FIG. 3C are diagrams showing a spur member shown in FIG. 1 and its attachment unit.
Figure 3B:
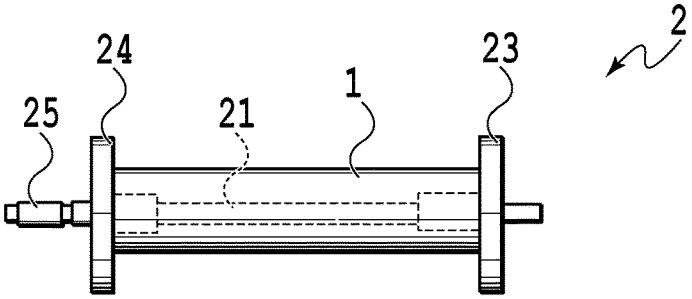
Figure 3C:
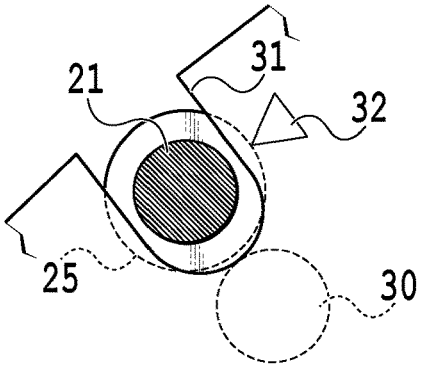

A configuration and procedure for setting the roll sheet 1 in the printing apparatus will be described with reference to FIG. 3A to FIG. 3C. FIG. 3A is a front view of the disassembled spur member 2 and FIG. 3B is a front view of the assembled spur member 2. FIG. 3C is a schematic cross-sectional view of an attachment unit of the roll sheet 1 on the printing apparatus body side.

In FIG. 3A, the spur member 2 includes a spur shaft 21, friction members 22, a reference spur flange 23, a non-reference spur flange 24, and a spur gear 25.

First, the non-reference spur flange 24 fitted into the spur shaft 21 is removed from the spur shaft 21 and the spur shaft 21 is inserted into the paper tube of the roll sheet 1. At this time, since there is a sufficient gap between the inside diameter of the paper tube of the roll sheet 1 and the outside diameter of the spur shaft 21, a user can insert the roll sheet 1 with a little force. As an end of the roll sheet 1 touches the reference spur flange 23, the friction member 22 provided on the inner side of the reference spur flange 23 in a use attitude touches the inner surface of the paper tube of the roll sheet 1.

Following that, the spur shaft 21 is inserted into the non-reference spur flange 24 so that the friction member 22 provided on the inner side of the non-reference spur flange 24 in the use attitude touches the inner surface of the paper tube of the roll sheet 1, thereby applying a lock to prevent the paper tube of the roll sheet 1 from moving from the spur member 2. As a result, the roll sheet 1 is set in the spur member 2 as shown in FIG. 3B. The spur member 2 is then set in the printing apparatus body.

In FIG. 3C, a spur holder 31 has a U-shaped cross section and is located in each of the reference and non-reference positions of the printing apparatus to correspond to each of the reference spur flange 23 and the non-reference spur flange 24 of the spur member 2. The spur member 2 can be attached and detached through an opening of the U-shape of the spur holder 31. The curved portion of the U-shape has a shape that fits to the spur shaft 21. A spur driving unit 30 on the printing apparatus body side is connected to the spur gear 25 provided in the spur member 2, thereby driving and rotating the spur member 2. The roll sheet 1 rotates forward and backward along with the spur member 2. The printing apparatus detects the presence and absence of the spur member 2 by using a spur presence/absence detection sensor 32.

(Sheet Discharging Unit)

Figure 2C:
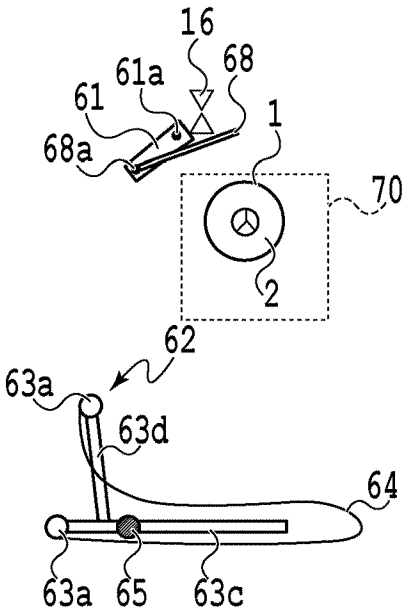
FIG. 2A to FIG. 2C are diagrams showing a movable configuration of a sheet discharging unit of the printing apparatus.
Figure 2B:
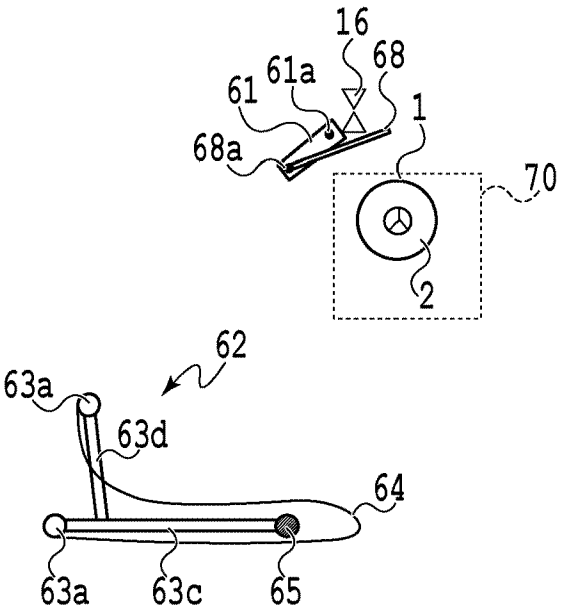

A configuration of the sheet discharging unit 500 will be described in detail with reference to schematic cross-sectional views of the printing apparatus shown in FIG. 2A to FIG. 2C and a perspective view of the printing apparatus shown in FIG. 4.

Figure 2A:
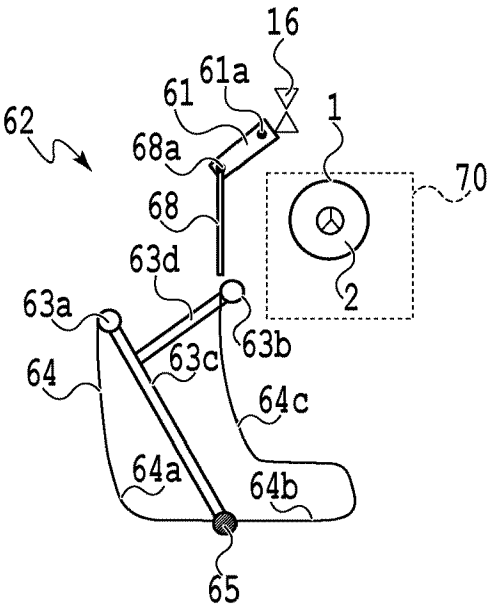
Figure 4:
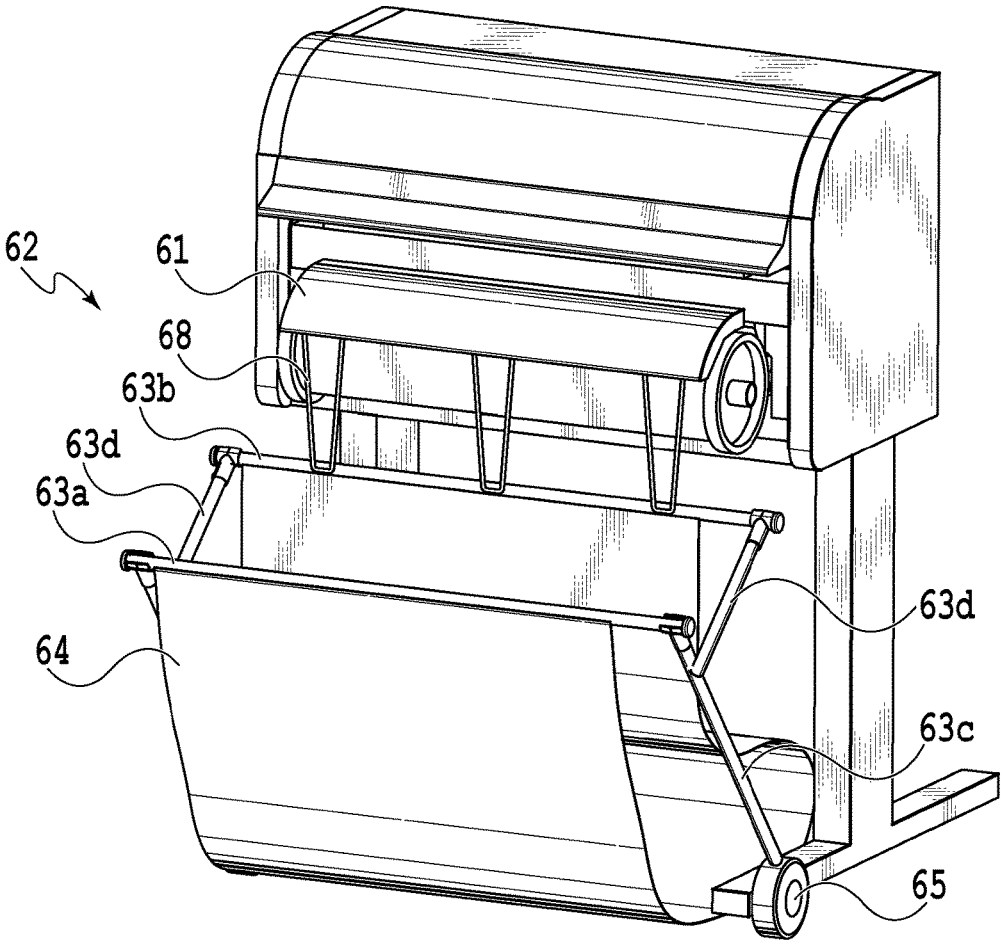
FIG. 4 is a perspective view showing the printing apparatus from the side of the sheet discharging unit.

FIG. 2A and FIG. 4 show a state of using the basket unit 62 in the sheet discharging unit 500. FIG. 2B shows a state where a movable guide member 68 is stored in the sheet discharging guide 61 and a basket portion of the basket unit 62 is closed. FIG. 2C shows a state where the basket unit 62 is stored under the feeding unit 70.

The sheet discharging guide 61 of this example is a molded component including a guide portion extending across the whole area in the width direction of the sheet. The movable guide member 68 is obtained by wire forming and can be moved between a position of being suspended vertically downward under its own weight and a position of being stored in the sheet discharging guide 61.

A thrust direction (axial direction) of the rods 63*a* and 63*b* is equal to the width direction of the sheet. Each end of the rod 63*a* is connected to one end of a corresponding one of two rods 63*c*. Each end of the rod 63*b* is connected to one end of a corresponding one of two rods 63*d*. The other ends of the rods 63*d* are connected to the rods 63*c*. The other ends of the rods 63*c* are attached to a stand side so as to turn around the axis 65. The rods 63*c* can turn up to a substantially-horizontal position as shown in FIG. 2B. The rods 63*c* can further move from the substantially-horizontal state in a thrust direction to be stored under the feeding unit 70 as shown in FIG. 2C.

The cloth 64 in the state of use shown in FIG. 2A includes a portion 64*a* located on the front side of the printing apparatus, a portion 64*b* located on the floor side, and a portion 64*c* located behind the discharged sheet. The portions 64*a* and 64*b* mainly accept the discharged sheet, thereby preventing the printed side of the sheet from touching the floor and becoming dirty. The portion 64*c* has the function of guiding the back of the sheet which is being printed or discharged. The portion 64*c* guides the sheet continuously from the sheet discharging guide 61 and the movable guide member 68 so that the discharged sheet does not enter the feeding unit 70 side. If the discharged sheet enters the feeding unit 70 side, there is a possibility of a jam (paper jam).

(Operation Sequence in Sheet Feeding)

Figure 5:
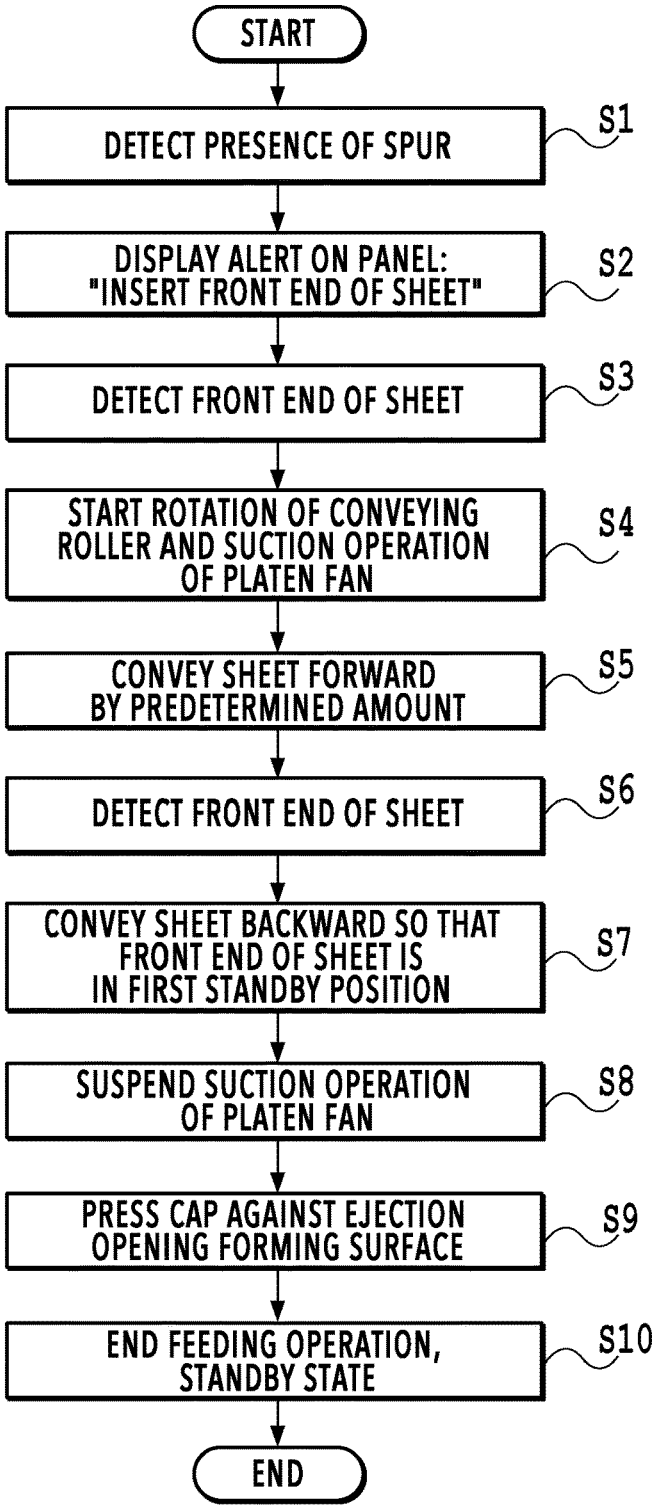
FIG. 5 is a flowchart showing an operation in sheet feeding in the printing apparatus.

An operation sequence in sheet feeding will be described with reference to a flowchart of FIG. 5. In the description below, reference signs in parentheses are step numbers in the flowchart. Further, a rotation in a sheet feeding direction is referred to as a forward rotation and a rotation in a direction opposite to the forward rotation is referred to as a backward rotation.

First, a user inserts the spur member 2 into the paper tube of the roll sheet 1 and sets the spur member 2 in the feeding unit 70, whereby the spur presence/absence detection sensor 32 provided in the spur holder 31 detects that the spur member 2 is attached (S1). If the attachment of the spur member 2 is detected, an operation panel displays an alert to instruct the user to perform an operation for inserting a front end 9 of the roll sheet into the conveying guide 8 (S2). If the user inserts the front end 9 of the sheet 1 into the conveying guide 8, the sheet front end detection sensor 12 detects the front end 9 of the sheet 1 (S3). If the front end of the sheet 1 is detected, the conveying roller 10 rotates forward. Further, a suction operation of the platen fan 14 is started to allow the platen 13 to suck the sheet 1 (S4). The sheet 1 is nipped between the conveying roller 10 and the pinch roller 11 and conveyed forward by a predetermined amount so that the front end of the sheet 1 is located at a downstream side of the conveying roller 10 (S5).

In this specification, "forward (first direction) conveyance" means conveyance of the sheet in the conveying direction (corresponding to the forward conveying direction or feeding direction) during printing (forward feeding) and "backward (second direction) conveyance" means conveyance of the sheet in a direction opposite to the forward direction (corresponding to a backward conveying direction, rewinding direction, or backward feeding).

Figure 11A:
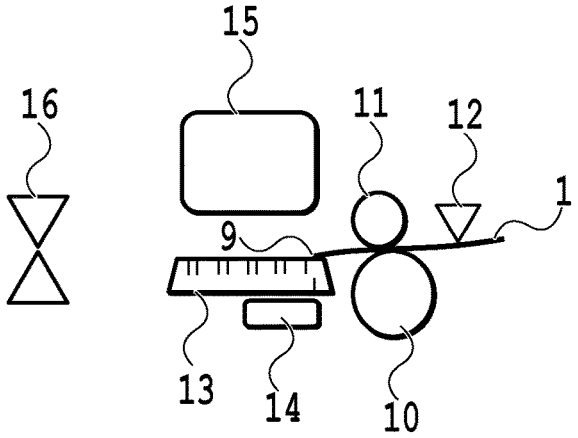
FIG. 11A to FIG. 11C are diagrams showing a positional relationship between a first standby position and a second standby position of a front end of a sheet.

After that, the position of the front end 9 of the sheet 1 is detected by a sensor (not shown) while conveying the sheet 1 backward (S6). If the front end 9 of the sheet 1 is located at an upstream side of a print area of the print head 15 in the forward direction and at a downstream side of the conveying roller 10 in the forward conveying direction, the backward conveyance of the sheet 1 is stopped (S7). FIG. 11A shows the position of the front end 9 of the sheet 1 at this time and this position is hereinafter referred to as "first standby position" or simply "first position". In this example, the position of the front end 9 of the sheet 1 which is about 2 mm distant from a position nipped with the conveying roller 10 and the pinch roller 11 is defined as the first standby position. That is, the front end 9 in the first standby position is located at a position away from the nip portion between the rollers 10 and 11 in the forward conveying direction. In this example, the first standby position is upstream of the print head 15 in the forward conveying direction. If the front end 9 of the sheet reaches the first standby position, the suction operation by the platen fan 14 is stopped (S8).

Figure 7:
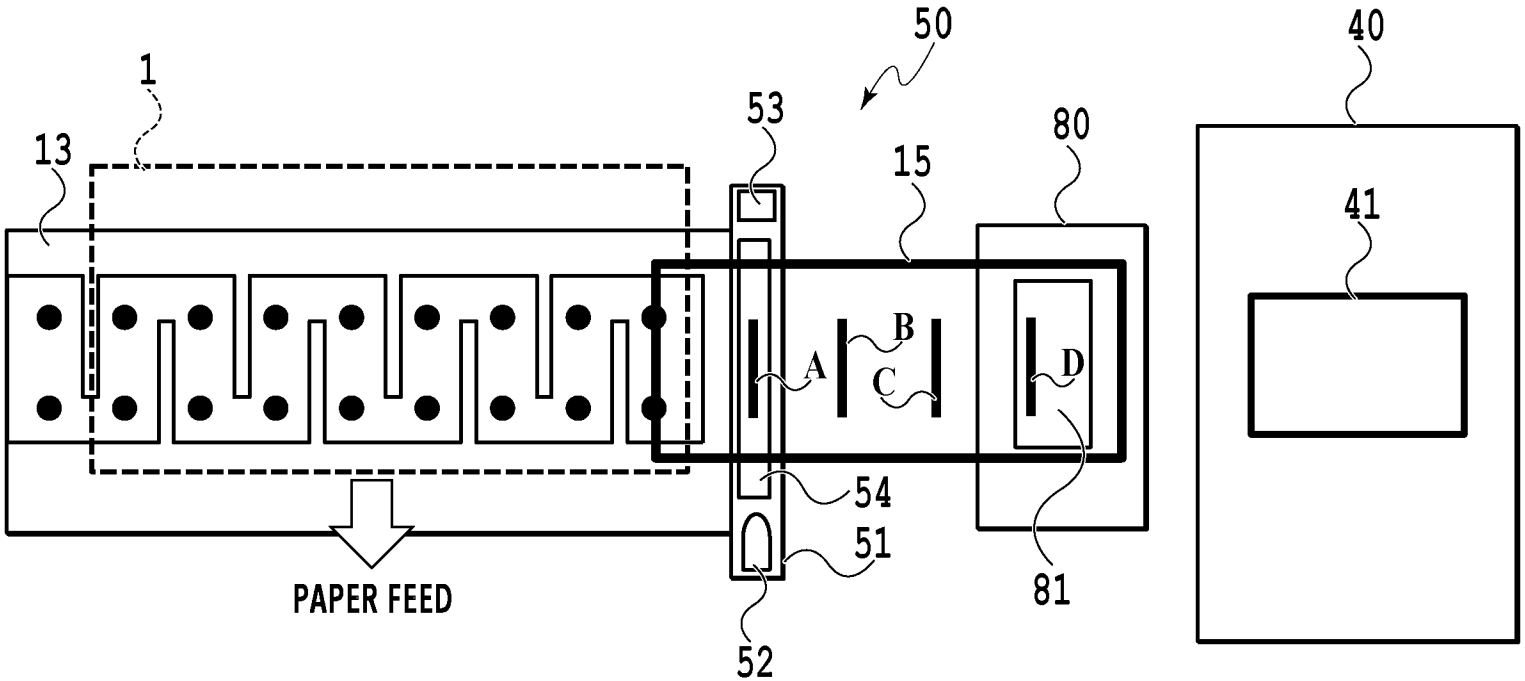
FIG. 7 is a top view of a printing unit shown in FIG. 1.

FIG. 7 is a top view of the printing unit including the print head 15 and the platen 13. A purge unit 40 is arranged adjacent to the platen 13 in the width direction of the sheet. After the suction operation of the platen fan 14 is stopped in step (S8), the print head 15 moves to a position directly above the purge unit 40 to face a cap 41 provided in the purge unit 40. The cap 41 is pressed against (touches) the ejection opening forming surface and covers (caps) the nozzles (S9). This can prevent the nozzles of the print head 15 from being exposed to outside air and prevent ink inside the nozzles from being dried, thereby reducing nozzle clogging caused by drying.

After the feeding operation described above, the apparatus is in a standby state for printing (S10).

(Operation Sequence in Single Image Printing)

Next, an operation sequence in the case of printing a single image will be described with reference to a flowchart of FIG. 6. In this specification, "image" in "image printing" collectively means an image(s) to be printed on one printed product (also referred to as a product) obtained by being separated from the roll sheet (continuous sheet) by the cutting operation after the print operation. The collective "image" may substantially include one or more images and may include one or more types of images. In the description below, reference signs in parentheses are step numbers in the flowchart.

Figure 11B:
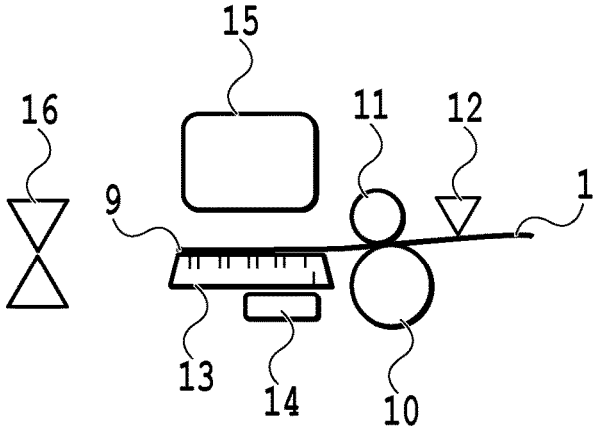

If print data is received from a host apparatus such as a personal computer (S11), the suction operation of the platen fan is started together with the start of the forward rotation of a conveying roller driving motor 35 (S12). The sheet 1 with the front end 9 located at the first standby position as shown in FIG. 11A is conveyed forward by a predetermined amount (S13). FIG. 11B shows the position of the front end 9 of the sheet after the conveyance. In this example, a margin of 3 mm is provided in a front end portion of the sheet 1 between the front end 9 of the sheet 1 and the beginning position of an image area. Accordingly, the sheet 1 is conveyed until the front end 9 of the sheet 1 reaches a position 3 mm distant from a position directly below the most downstream nozzle (that is, a print area of the print head 15) in the forward conveying direction of the print head 15. After that, an image is printed (a printing operation is performed) by ejecting ink from the print head 15 during the movement of the carriage in the width direction of the sheet (S14).

If the sheet 1 is kept nipped for a long time, the surface of the sheet 1 may be warped. In particular, if the sheet 1 is glossy paper, a warp in an ink accepting layer of the surface causes conspicuous deterioration in quality of a printed image (image quality). In the case where the front end 9 of the sheet 1 is in the first standby position shown in FIG. 11A, the conveying roller 10 and the pinch roller 11 nip the margin of the sheet 1 outside the image area. Since the margin outside the image area is nipped in the case where the front end 9 of the sheet is in the first standby position, the warp in the sheet does not affect the quality of the printed image.

In the present embodiment, printing processing can also be performed using a printing mode in which no margin is provided around an image area on a sheet (borderless printing) depending on a setting of a print mode or the like. In the borderless printing, an area at the front end of the sheet 1 including a portion which was nipped when the front end 9 of the sheet was in the first standby position is cut away. Therefore, also in the borderless printing, a warp in the sheet caused by long time nipping does not affect the quality of the printed image.

The printing operation will be described in more detail. During the forward movement of the carriage, the print head 15 mounted on the carriage prints an image of one line. Then, the conveying roller 10 rotates forward to convey the sheet 1 forward by a predetermined amount. Next, during the backward movement of the carriage, the print head 15 mounted on the carriage prints an image of the next line. In this manner, the forward and backward movements of the print head 15 and the forward conveyance operation of the conveying roller 10 by the predetermined amount are repeated, thereby printing an image on the sheet 1. At this time, a roll driving motor 34 (driving unit) is controlled to rotate the roll sheet backward along with the forward conveyance operation by the forward rotation of the conveying roller 10. Since the control over the roll driving motor 34 reduce a driving force by current limiting, the sheet 1 is pulled and conveyed by the conveying roller 10 with a force greater than the driving force of the roll driving motor 34. The purpose of this control is to apply an appropriate back tension to the roll sheet 1 and realize stable conveyance without slack.

If the image printing operation is finished (S15), the conveying roller 10 conveys the sheet 1 forward until the rear end of the printed portion reaches the cutting position of the cutter 16 (S16). Then, a cutter driving motor (not shown) actuates the cutter 16 to cut the sheet (S17). The printed product separated from the continuous sheet by this cutting is stored in the basket unit 62. The sheet 1 left on the printing apparatus side is conveyed backward by a predetermined amount by the conveying roller 10 so that a new front end 9 of the sheet 1 created by the cutting is returned to the first standby position (S18). After that, the suction operation of the platen fan is suspended (S19), the cap is pressed against the ejection opening forming surface (S20), and the printing operation is finished and the apparatus is in a standby state for printing (S21).

The above is description of the control flow of the printing operation in the case of printing a single image.

(Detection of Ink Ejection State in Nozzle)

Figure 8:
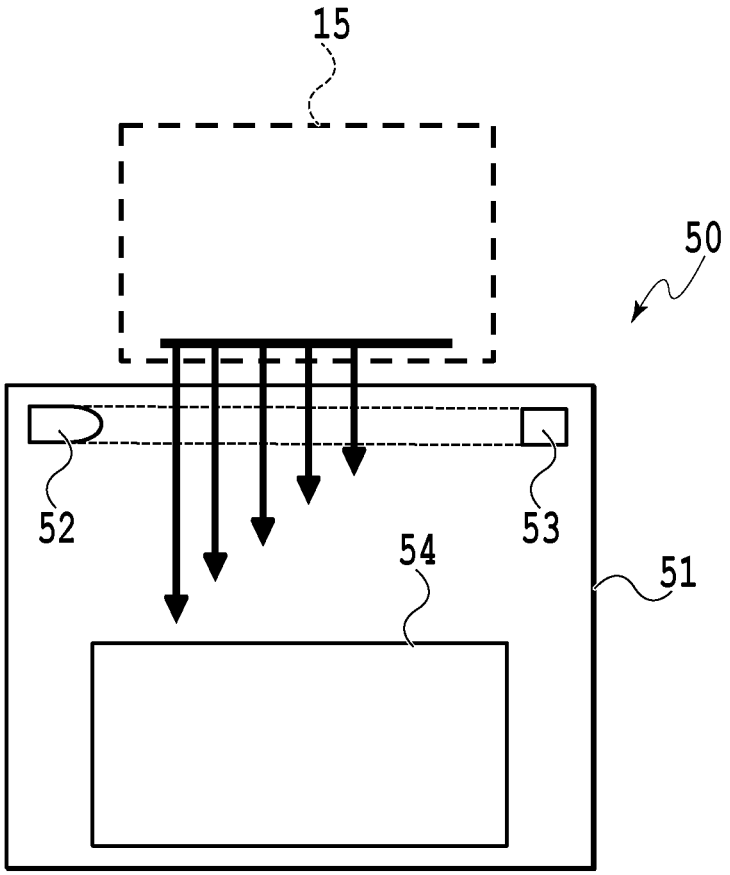
FIG. 8 is a side view of an ink non-ejection detection unit.

The detection of an ink ejection state in a nozzle will be described with reference to FIG. 7 and FIG. 8. In this example, whether a nozzle is in a non-ejection state in which the nozzle cannot normally eject ink is detected. FIG. 7 is a top view of the printing unit inside the printing apparatus. FIG. 8 is a side view of an ink non-ejection detection unit.

The non-ejection of nozzle is a kind of abnormality of the print head and means a state in which an ink droplet cannot be normally ejected from a nozzle because of nozzle clogging or the like. A nozzle in the non-ejection state is referred to as a non-ejection nozzle. If there is a non-ejection nozzle, a printed image includes a stripe low-density portion in a position corresponding to the non-ejection nozzle, which deteriorates image quality.

The number of ink ejections by each nozzle is counted during image printing, and if the count reaches a predetermined number of ejections, ink non-ejection detection processing is performed before the start of printing of the next image. That is, the ink non-ejection detection is performed between an image printing operation and the next image printing operation. Further, even if print data on the next image is received, the printing operation is temporarily interrupted by the non-ejection detection processing (that is, interrupt processing is performed). The quality of a printed image can be maintained by regularly performing the non-ejection detection in this manner.

As shown in FIG. 7, a detection unit 50 which detects ink non-ejection is provided in a non-print area in the printing apparatus. The detection unit 50 includes a unit casing 51, an LED 52 which is a light-emitting element, a photodiode 53 which is a light-receiving element, and a sponge 54 which is an absorbent for absorbing ink droplets that have passed through a pencil of light between the LED 52 and the photodiode 53.

The print head 15 has four nozzle arrays A to D. First, in order to perform the ink non-ejection detection for the nozzle array A, the print head 15 is moved so that the nozzle array A overlaps the pencil of light between the LED 52 and the photodiode 53. In this state, each nozzle of the nozzle array A is sequentially caused to eject ink. At this time, a voltage level of the photodiode 53 is observed to determine whether each nozzle is a non-ejection nozzle. After the ink non-ejection detection for the nozzle array A, the print head 15 is moved so that the nozzle array B overlaps the pencil of light and then the nozzle array B is subjected to the non-ejection detection. The nozzle arrays C and D are similarly subjected to the non-ejection detection.

Figure 9:
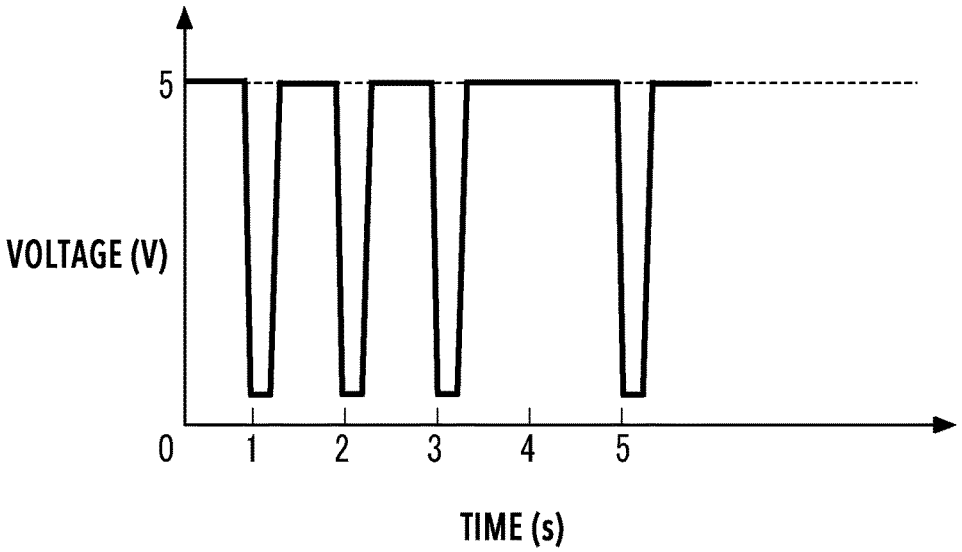
FIG. 9 is a diagram showing an output waveform in the non-ejection detection unit shown in FIG. 8.

FIG. 9 shows an output waveform of the photodiode 53 in the non-ejection detection for the nozzle array A. FIG. 9 shows the output of the photodiode 53 as a voltage. In this example, settings are made so that an ink ejection interval is one second in the case of sequentially ejecting ink from each nozzle and a voltage is 5V in the case of irradiating the light-receiving element with light from the light-emitting element without a cutoff of the light. An ink droplet is ejected from a nozzle and passes through the pencil of light between the LED 52 and the photodiode 53, whereby the light is temporarily cut off and the voltage level of the photodiode 53 decreases. This change in voltage level is used to determine whether each nozzle is in a non-ejection state. In the case of FIG. 9, since the voltage level does not change four seconds after the start of non-ejection detection, it is determined that the fourth nozzle (nozzle 4) of the nozzle array A is a non-ejection nozzle. The same detection operation is performed for the nozzle arrays B to D. If there is a non-ejection nozzle, the purge unit 40 performs a recovery operation for nozzle clogging by sucking and collecting ink in the print head.

The detection unit 50 is located adjacent to the platen 13. Accordingly, if the suction operation of the platen fan is performed at the time of the non-ejection detection operation, an airflow produced by the suction may cause an ink droplet ejected from a nozzle to deviate from the pencil of light. In this case, even if ink is normally ejected, the voltage does not change unlike normal ink ejection and a nozzle is incorrectly determined to be in a non-ejection state. Therefore, the platen fan is stopped in the case of performing the non-ejection detection operation.

(Control System)

Figure 14:
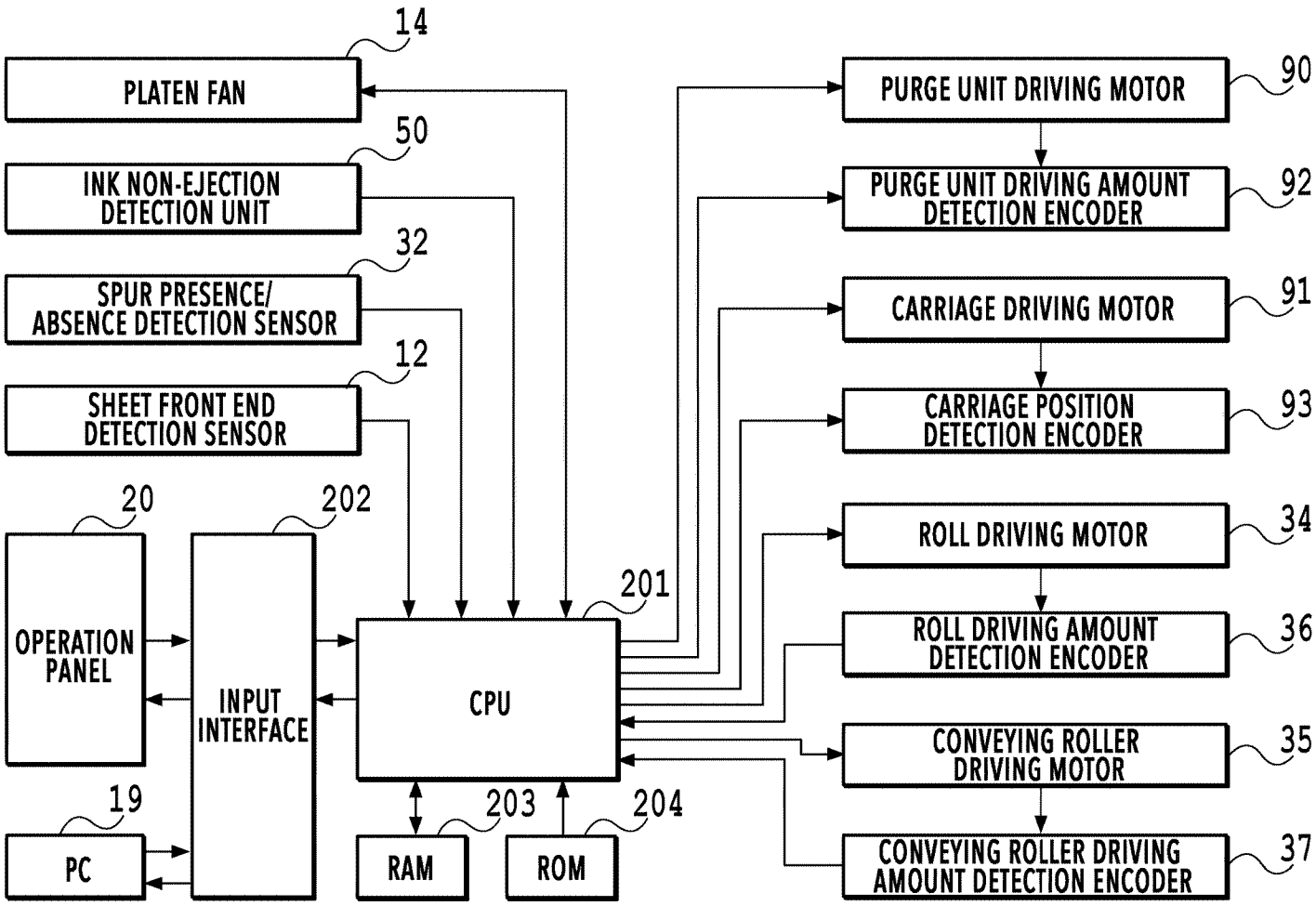
FIG. 14 is a block diagram of a control system of the printing apparatus.

A control system in the printing apparatus will be described with reference to a block diagram of FIG. 14. A CPU 201 controls the feeding unit 70, the printing unit 400, and the like in accordance with a control program stored in a ROM 204.

Information concerning the type of roll sheet 1 and the like which is input by a user from an operation panel 20 (an operation display unit; also simply referred to as a panel or display unit) is transferred to the CPU 201 via an input interface 202. Similarly, information concerning print data such as image data and image quality setting data (print mode) is transferred from a personal computer (PC) 19 to the CPU 201 via the input interface 202. The information concerning the type of roll sheet and the like and the print data which are transferred to the CPU 201 are written in a RAM 203. The printing apparatus is controlled based on control parameters and the like according to the type of roll sheet and the image quality settings stored in the ROM 204.

The CPU 201 receives detection results from the spur presence/absence detection sensor 32, the sheet front end detection sensor 12, and the detection unit 50. The CPU 201 displays an alert (makes a notification) on the operation panel 20 to urge a user to perform an operation based on the detection results and signals to be described later, and instructs various motors, the platen fan, and the like to perform operations in accordance with a predetermined control program stored in the ROM 204.

That is, the CPU 201 transmits rotation control signals to the platen fan 14, the purge unit driving motor 90, the carriage driving motor 91 which reciprocally moves the carriage equipped with the print head 15, the roll driving motor 34, and the conveying roller driving motor 35. Further, the CPU 201 receives signals from driving amount detection encoders 92, 93, 36, and 37 related to operations of the respective motors and controls the rotation of each motor.

(Operation Sequence in Consecutive Printing of Multiple Images)

Next, an operation sequence in the case of consecutively printing a plurality of images will be described.

Figure 6:
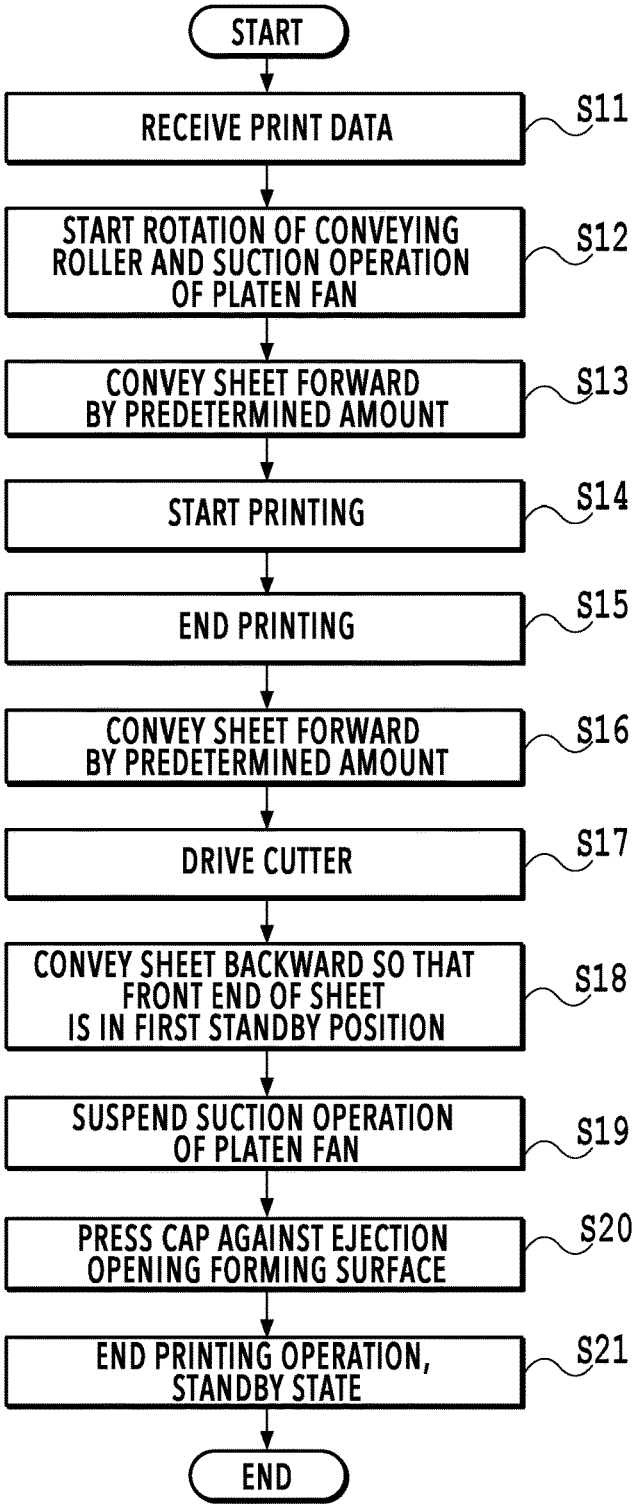
FIG. 6 is a flowchart showing an operation in single image printing in the printing apparatus.
Figure 11C:
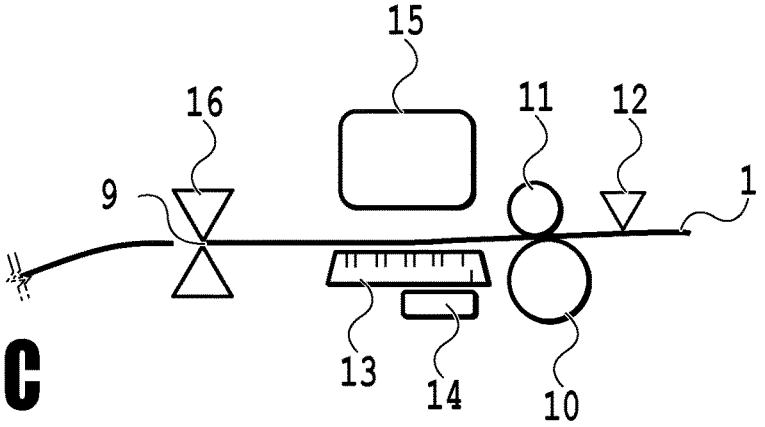

In the flowchart of FIG. 6, after the cutting operation in the state of FIG. 11C (S17), the sheet is conveyed backward so that a new front end 9 of the sheet 1 is in the first standby position as shown in FIG. 11A (S18). At this time, for a printing operation of the next image, it is necessary to convey the sheet 1 forward to move the front end 9 of the sheet from the first standby position to the position shown in FIG. 11B. Accordingly, in the case of consecutively printing a plurality of images, since the sheet is conveyed backward and then conveyed forward, the printing processing takes a long time.

In view of the above, in consecutive printing processing of the present embodiment, after the cutting operation in the state of FIG. 11C, the new front end 9 of the sheet 1 is directly moved to a print start position of the next image without being pulled back to the first standby position of FIG. 11A. That is, the sheet is conveyed backward (pulled back) so that the front end of the sheet is in the print start position of the next image as shown in FIG. 11B, followed by the printing of the next image. During the processing, it is preferable that the suction operation of the platen fan be continued to prevent the sheet from floating from the platen.

In the description below, a position to which the front end 9 of the sheet 1 is pulled back in the case of consecutively printing a plurality of images is referred to as "second standby position" or simply "second position". The second standby position should not necessarily be a print start position of the next image. For example, if a means to detect the position of the front end of the sheet (a sensor not shown) is located near the center of the print head 15, the position of the means may be the second standby position to which the front end of the sheet is pulled back. Any position may be defined as the second standby position as long as it is located at the downstream side in the conveying direction of the sheet as compared with the first standby position of FIG. 11A described above. With the configuration described above, a time required for sheet conveyance can be reduced in the consecutive printing processing.

Incidentally, in the case where an interrupt occurs at the timing of performing the non-ejection detection between an image printing operation and the next image printing operation, it is necessary to suspend (stop) the suction operation of the platen fan to avoid incorrect detection of ink non-ejection as described above. However, for example, in a case where the front end 9 of the sheet 1 is in the second standby position, suspending the suction operation of the platen fan removes a negative pressure for keeping the sheet substantially flat on the platen. Consequently, the sheet tends to float above the platen due to curl of the roll sheet. Further, as shown in FIG. 7, the print head 15 passes above the platen 13 to the position of the detection unit 50 located adjacent to the platen 13 in the non-ejection detection. At this time, an end of the sheet floating from the platen 13 may touch the print head 15, which may result in a sheet jam or the like.

Therefore, in the present embodiment, in the case of preforming the non-ejection detection operation between an image printing operation and the next image printing operation, the suction operation of the platen fan is suspended after the sheet is conveyed backward so that the front end of the sheet is in the first standby position. Then, the non-ejection detection operation is performed.

Figure 10:
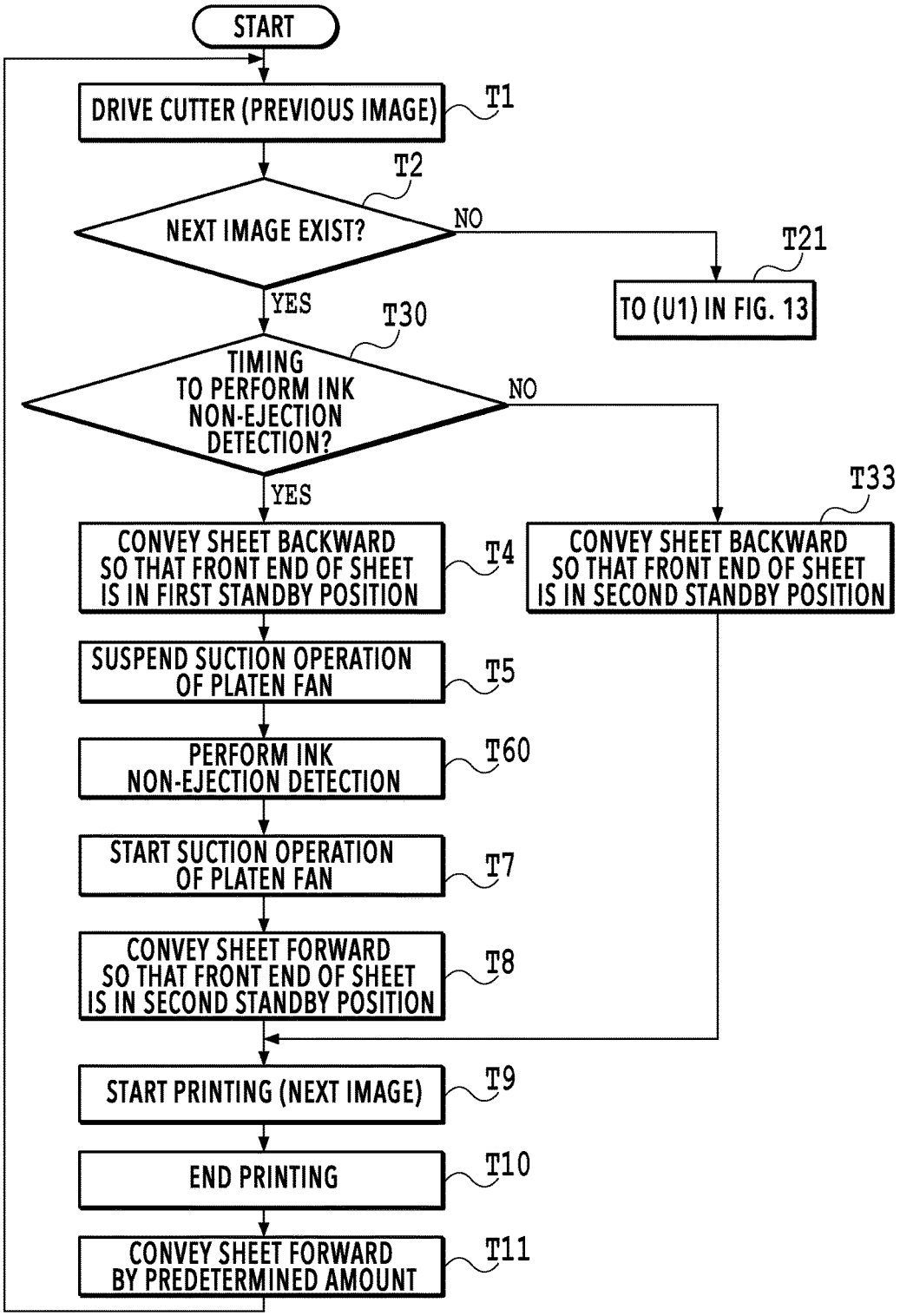
FIG. 10 is a flowchart showing an operation in multiple image printing in the printing apparatus.

FIG. 10 is a flowchart showing an operation sequence in the case of consecutively printing a plurality of images. In the description below, reference signs in parentheses are step numbers in the flowchart.

(T1) in FIG. 10 denotes the same operation as that in (S17) of FIG. 6, namely, the cutting operation for cutting the sheet after printing the previous image. In FIG. 10, the description of steps corresponding to (S11) to (S16) in the flow of FIG. 6 is omitted. After the sheet cutting operation, it is determined whether there is the next image to be consecutively processed (T2).

Figure 13:
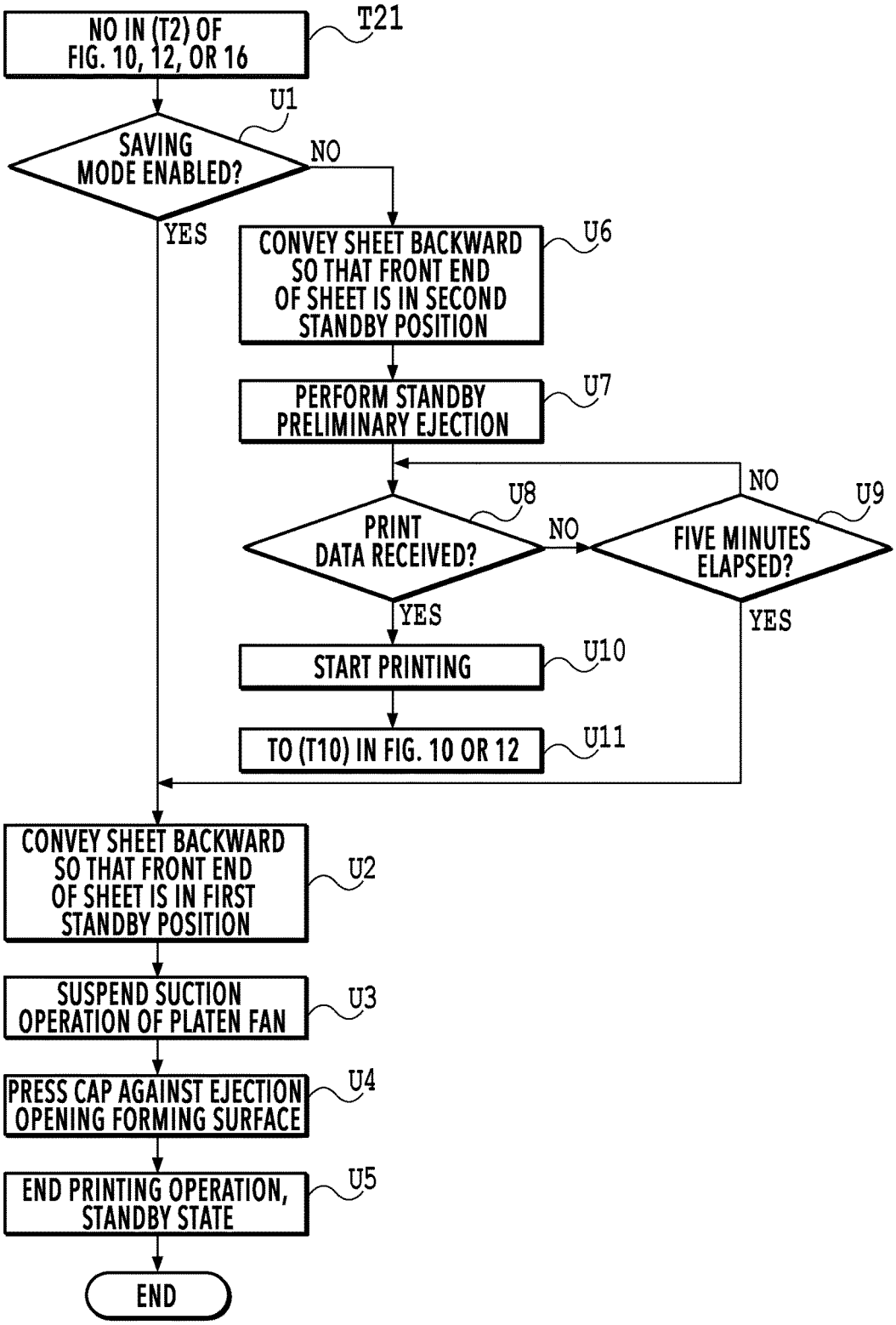
FIG. 13 is a flowchart showing an operation in the absence of the next image in a third embodiment of the present invention.

If it is determined that there is no next image, the processing proceeds to (U1) in a flow of FIG. 13 (T21). A subsequent flow will be described later with reference to FIG. 13.

Returning to FIG. 10, if it is determined that there is the next image in step (T2), it is determined whether it is a timing to perform the non-ejection detection operation (T30). As described above, the timing to perform the non-ejection detection operation is, for example, when the count of the number of ink ejections by each nozzle reaches the predetermined number of ejections.

If it is determined that it is a timing to perform the non-ejection detection operation, the sheet is conveyed backward so that the front end of the sheet is in the first standby position (T4) and the suction operation by the platen fan is stopped (T5). After that, the non-ejection detection operation is performed (T6) and then the platen fan is driven (T7). Following that, the sheet is conveyed forward so that the front end of the sheet is in the second standby position (T8).

On the other hand, if it is not determined that it is a timing to perform the non-ejection detection operation in step (T30), the sheet is conveyed backward so that the front end of the sheet is in the second standby position (T33).

In the case where the second standby position in steps (T8) and (T33) is a print start position of the next image, the printing operation of the next image is started without conveying the sheet (T9). In the case where the second standby position is a position upstream of the print start position in the forward conveying direction, the printing operation is started after the sheet is conveyed forward. During the sheet conveyance operation and the printing operation, the platen fan is continuously driven and therefore the sheet does not float from the platen.

After the printing operation (T10), the sheet 1 is conveyed forward by a predetermine amount (T11) and the cutting operation is performed (T1).

As described above, in the present embodiment, a sheet jam and the like can be avoided and a processing time can be reduced between an image printing operation and the next image printing operation.

Second Embodiment

In the first embodiment, the suction operation of the platen fan is suspended along with the execution of the ink non-ejection detection. The same operation sequence is also applicable to the case of suspending the suction operation of the platen fan for a different reason.

Figure 12:
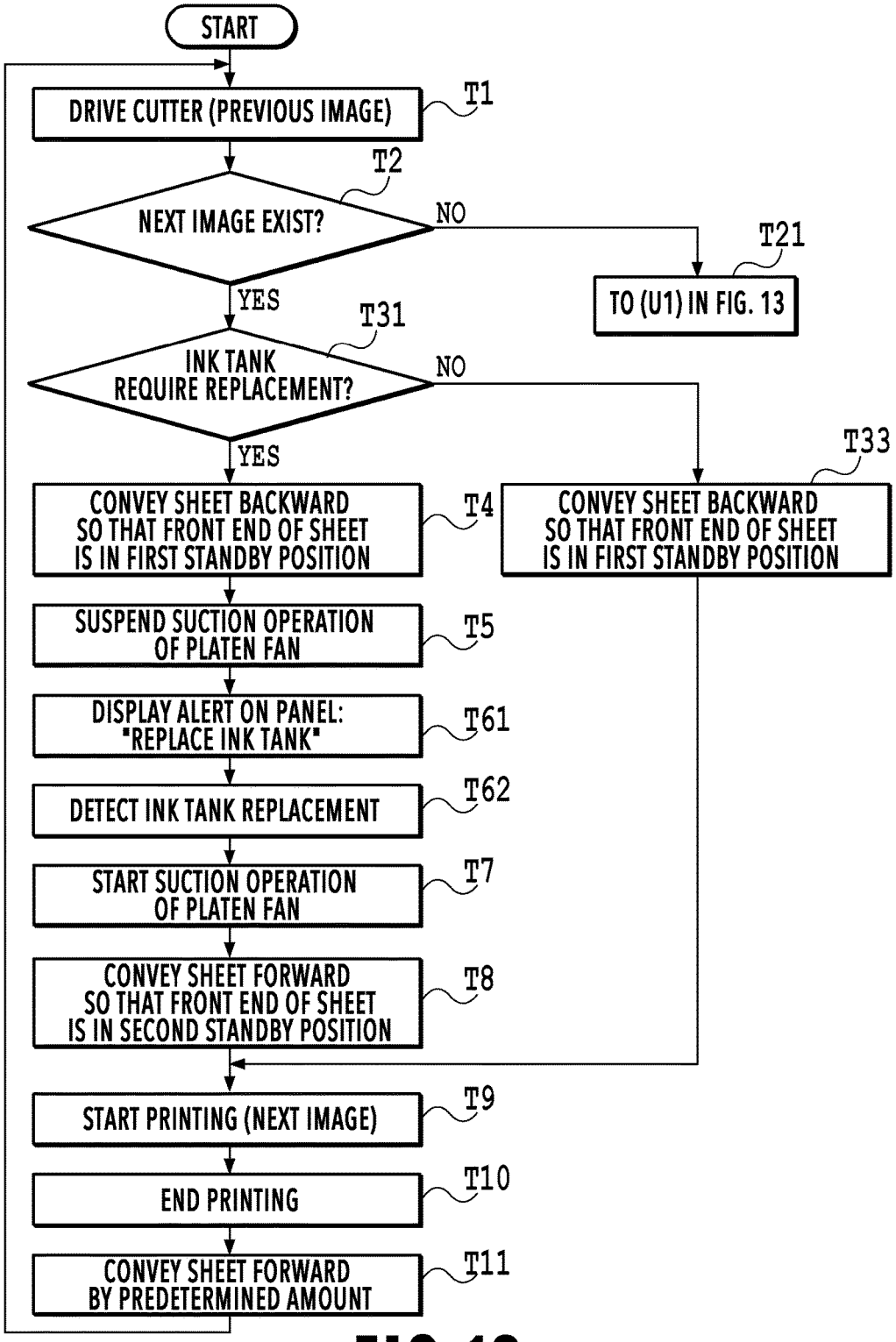
FIG. 12 is a flowchart showing an operation in multiple image printing in a second embodiment of the present invention.

FIG. 12 is a flowchart showing, as an example of the present embodiment, processing in the case where there is insufficient ink to print the next image (that is, the amount of ink in the ink tank is less than a predetermined amount) and the ink tank is replaced between an image printing operation and the next image printing operation because of the insufficient ink. In the description below, reference signs in parentheses are step numbers in the flowchart. Description will be omitted for steps denoted by the same reference signs as those for the steps that have already been described.

Since the ink tank is replaced by a user, the replacement often takes a long time. Accordingly, in consideration of power consumption, it is preferable that the suction operation of the platen fan be suspended (stopped) during the ink tank replacement. However, as described above, if the suction operation of the platen fan is suspended in the case where the front end 9 of the sheet 1 is in the second standby position, a negative pressure for keeping the sheet substantially flat on the platen is not applied and the sheet tends to float from the platen due to curl of the roll sheet. Further, in a configuration of mounting the ink tank on the carriage equipped with the print head, the print head 15 moves above the platen 13 along with the ink tank replacement operation. At this time, an end of the sheet floating from the platen may touch the print head or carriage, which may result in a sheet jam or the like.

In view of the above, in the present embodiment, if it is determined that the ink tank should be replaced (i.e., the amount of ink in the ink tank is less than the predetermine amount) (T31), the sheet is first conveyed backward to move the front end 9 of the sheet 1 to the first standby position (T4) so as to avoid the jam or the like. Then, the suction operation of the platen fan is suspended (T5). After that, notification processing for an ink tank replacement period or the like is performed by, for example, displaying a message on the panel to urge ink tank replacement (T61). If it is detected that the ink tank is replaced by a user (T62), the suction operation of the platen fan is started again (T7). Then, the sheet is conveyed forward so that the front end of the sheet is in the second standby position (T8) and printing of the next image is started (T9).

Like the first embodiment, in the case where the second standby position in steps (T8) and (T33) is a print start position, the printing operation is started without sheet conveyance (T9). In the case where the second standby position is upstream of the print start position in the forward conveying direction, the printing operation is started after the sheet is conveyed forward (T9).

In the above description of control for changing the standby position of the front end 9 of the sheet 1, two cases, that is, the case of ink non-ejection detection and the case of ink tank replacement for compensating for a shortage of ink, have been used as examples of the case where it is necessary to perform interrupt processing which temporarily suspends printing between an image printing operation and the next image printing operation. However, the present invention is not limited to these two cases and is widely applicable to sheet conveyance in the case of temporarily suspending printing between an image printing operation and the next image printing operation.

Third Embodiment

Next, processing (T21) in the case where it is determined that there is no next image to be consecutively processed in (T2) in FIG. 10 and FIG. 12 will be described with reference to FIG. 13.

If it is determined that there is no next image to be consecutively processed, it is determined whether a setting of a saving mode is enabled regarding a print mode which can be arbitrarily set by a user via the panel (U1).

First, the case where it is determined that the setting of the saving mode is enabled is described. In this case, the sheet 1 is conveyed backward so that the front end 9 of the sheet 1 is in the first standby position (U2) and then the suction control of the platen fan is suspended (U3). After that, as described above, the cap 41 in the purge unit is lightly pressed against (brought into contact with) the ejection opening forming surface to cover (cap) the ejection opening forming surface (U4) so as to prevent ink in the nozzles from being dried. The printing apparatus is in the standby state (U5) until print data on the next image is received. That is, (U2) to (U5) in the flow of FIG. 13 are the same as (S18) to (S21) in the flowchart of FIG. 6 showing the operation sequence in single image printing.

Next, the case where a user disables the setting of the saving mode is described. In this case, the sheet 1 is conveyed backward so that the front end 9 of the sheet 1 is in the second standby position (U6). After that, an operation of ejecting a predetermined amount of ink from the nozzles of the print head 15 to a standby preliminary ejection opening 80 shown in FIG. 7 is repeated at regular intervals (U7). This ink ejection control in (U7) is hereinafter referred to as "standby preliminary ejection". The purpose of the standby preliminary ejection is to reduce nozzle clogging by ejecting ink before ink in the nozzles of the print head is dried and the thickening of the ink progresses. The ink ejected to the standby preliminary ejection opening 80 is collected to a waste ink box (not shown) through a preliminary ejection hole 81. The standby preliminary ejection saves the need to press the cap against the ejection opening forming surface (U4), which is performed in the case where the setting of the saving mode is enabled. In the standby preliminary ejection, since the print head 15 moves from a position above the sheet 1 to the standby preliminary ejection opening 80 adjacent to the platen 13, the suction operation of the platen fan is continued to avoid a sheet jam or the like. In the present embodiment, the apparatus waits print data on the next image in this state (U8).

At this time, the front end 9 of the sheet 1 is in the second standby position and the print head 15 is not pressed against (not in contact with) the cap 41. Further, the second standby position in this example is the print start position of the next image. Accordingly, a printing operation of the next image can be started (U10) immediately after the receipt of print data. (U10) in FIG. 13 corresponds to (T9) in FIG. 10 and FIG. 12. After the start of the printing operation, the processing proceeds to (T10) in FIG. 10 or FIG. 12 (U11).

In the case where the saving mode is disabled, a time between the receipt of print data on the next image and the start of printing can be reduced and this is advantageous to a user. However, ink is wasted by the standby preliminary ejection and power consumption increases to continue the suction control of the platen fan, which are disadvantageous to a user. Therefore, a user can arbitrarily set the saving mode as described above.

Further, in the present embodiment, if print data on the next image is not received within a predetermined elapsed time (five minutes in this example) (U9), the control is performed in the same manner as steps (U2) to (U5) ([S18] to [S21] in the flowchart of FIG. 6). Therefore, even if the setting of the saving mode is disabled, the apparatus does not wait the receipt of the print data on the next image more than necessary.

As described above, in the first to third embodiments of the present invention, the sheet 1 is conveyed backward to pull the front end 9 of the sheet 1 back to the second standby position in the case of consecutively printing a plurality of images or printing the next image within a predetermined time. Further, if a certain time has elapsed without the execution of ink non-ejection detection, ink tank replacement, or printing of the next image, the sheet 1 is conveyed backward to pull the front end 9 of the sheet 1 back to the first standby position in preparation for the next printing operation. According to the printing apparatus having the configuration described above, it is possible to reduce a time required for sheet conveyance between an image printing operation and the next image printing operation while preventing a deterioration of quality of printed images and the occurrence of a sheet jam and the like.

Further, instead of the suction by the platen fan 14, electrostatic attraction or the like may be used to prevent the sheet from floating above the platen. Since ink droplets generally have the property of being attracted by static electricity, the electrostatic attraction operation should also be suspended (stopped) like the suction operation by the platen fan 14. Further, the electrostatic attraction generally requires higher power compared with the suction operation by the platen fan or the like. Accordingly, power consumption in the standby state can be reduced by suspending (stopping) the electrostatic attraction operation like the suction operation by the platen fan 14.

Fourth Embodiment

As described above, in the case where the standby position of the front end of the sheet before the start of the next image printing is the second standby position, the surface (ink accepting layer) of the sheet may be warped by nipping the sheet for a long time, which may result in a deterioration of image printing quality (image quality). Such a phenomenon tends to occur particularly in the case where the sheet is glossy paper. Therefore, control to switch the standby position of the front end of the sheet depending on the type of sheet is also effective. The fourth embodiment will be described with reference to a flowchart of FIG. 15. Since (S14) to (S21) in FIG. 15 are the same as the steps in the flowchart of FIG. 6 denoted by the same reference signs, detailed description will be omitted.

Figure 15:
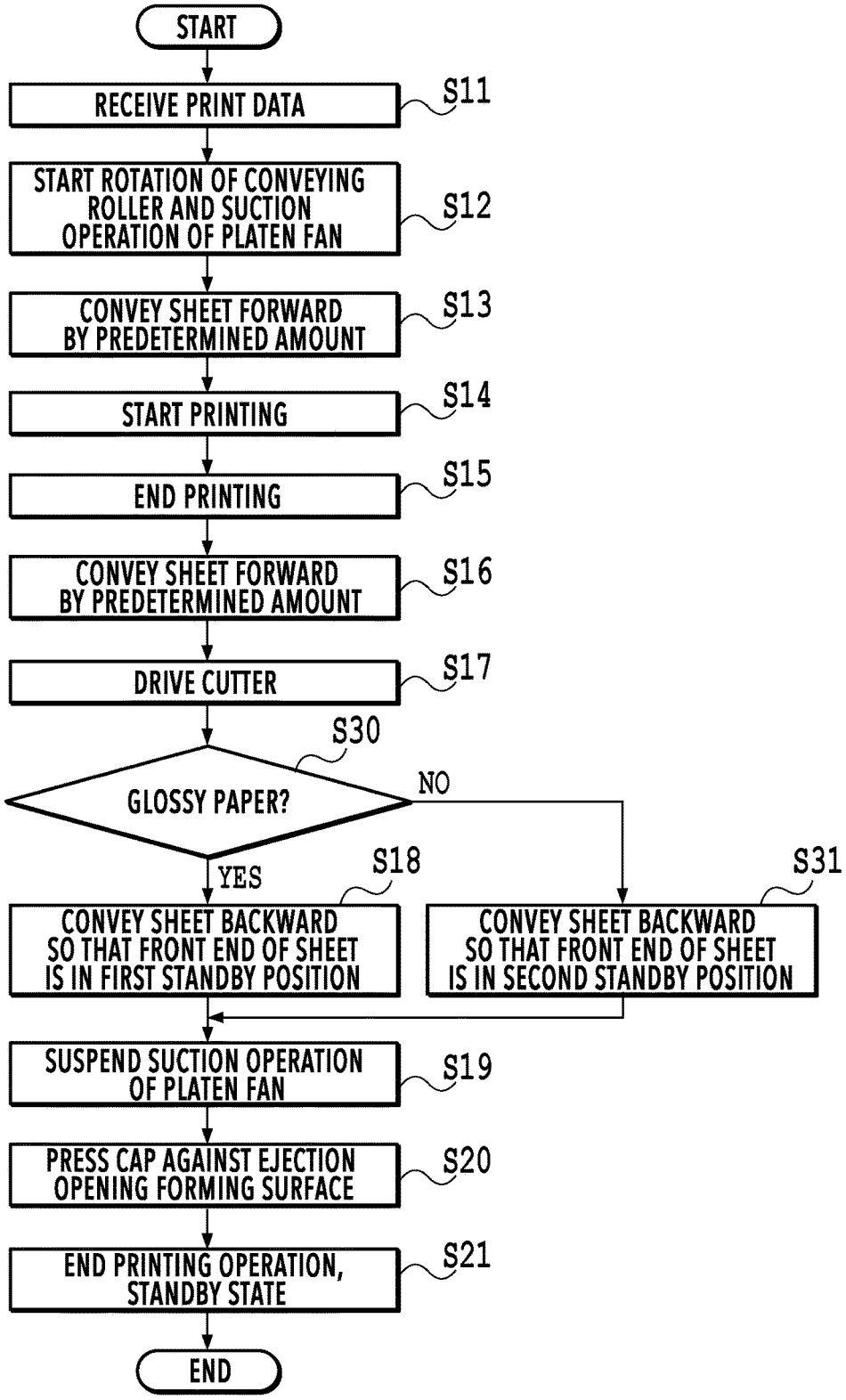
FIG. 15 is a flowchart showing an operation in image printing in a fourth embodiment of the present invention.

After the cutting operation of the sheet with the cutter in (S17) of FIG. 15, it is determined whether the type of sheet is glossy paper (S30). The type of sheet is determined based on information input by a user via the operation panel or PC and written in the RAM 203 as described above. If it is determined that the type of sheet is glossy paper, the sheet is conveyed backward to pull the front end 9 of the sheet back to the first standby position (S18). In contrast, if it is determined that the type of sheet is other than glossy paper, the sheet is conveyed backward to pull the front end 9 of the sheet back to the second standby position (S31).

As described above, in the case of a sheet with an ink accepting layer prone to be warped such as glossy paper, the front end of the sheet is pulled back to the first standby position and a margin outside an image area on the sheet is nipped, thereby preventing image printing quality (image quality) from being affected by a warp in the sheet caused by nipping. In the case of a sheet with an ink accepting layer which is not warped (or warped so slightly that it is not conspicuous) such as plain paper or coated paper, the front end of the sheet is pulled back to the second standby position. In this manner, the pullback position is changed to reduce a time required for sheet conveyance and increase a printing speed.

Fifth Embodiment

Figure 16:
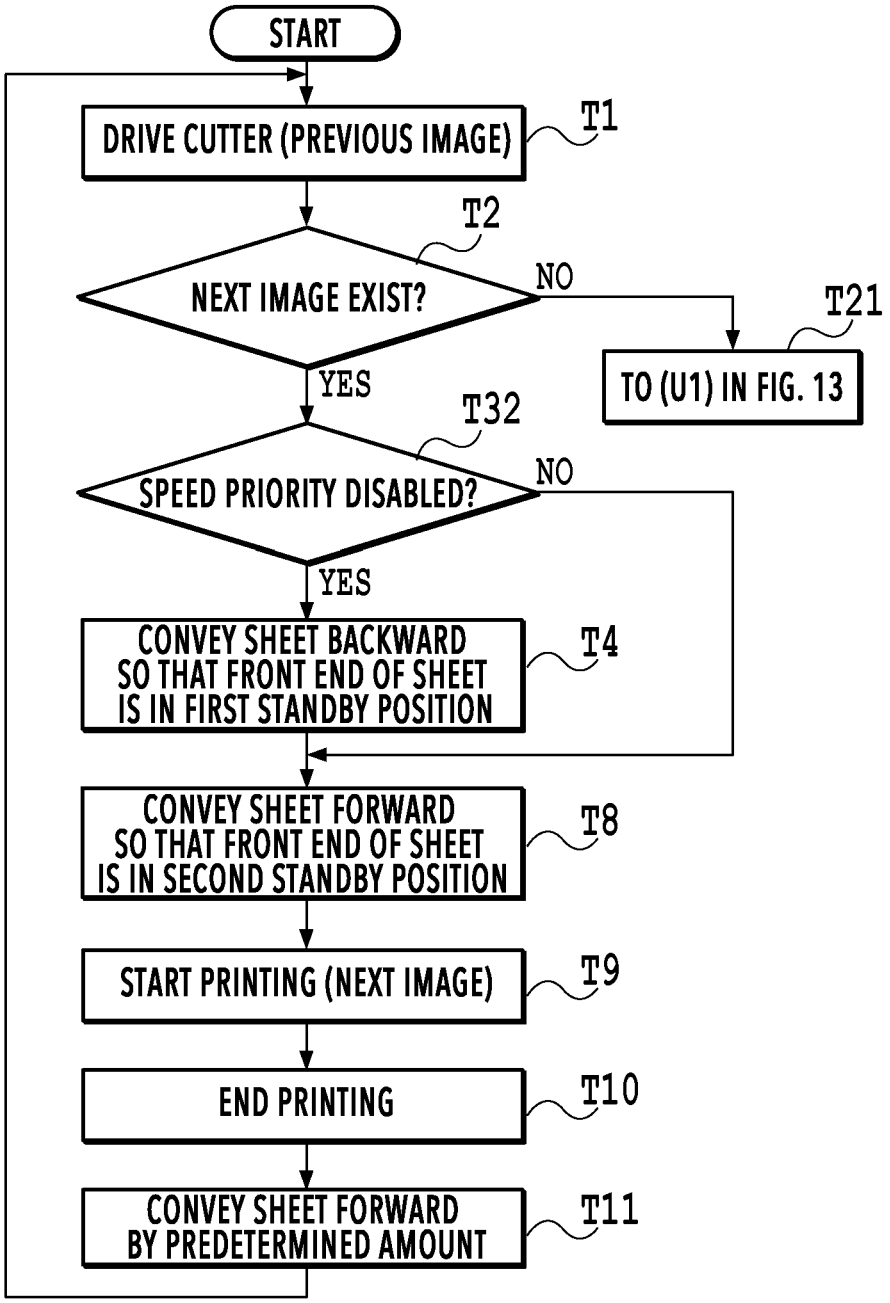
FIG. 16 is a flowchart showing an operation in image printing in a fifth embodiment of the present invention.

In the fifth embodiment, in the case of consecutively printing a plurality of image, the standby position of the front end of the sheet after the sheet cutting operation is switched according to the print mode setting in the PC. FIG. 16 is a flowchart showing the present embodiment. Since (T1), (T2), (T21), (T4), and (T8) to (T11) in FIG. 16 are the same as the steps in FIG. 10 denoted by the same reference signs, detailed description will be omitted.

In the present embodiment, in the case of inputting print data from the PC and performing a printing operation, a user can arbitrarily enable or disable a setting of speed priority. The setting of speed priority is a kind of print mode setting for giving a printing speed higher priority than image quality.

In (T2) of FIG. 16, if print data on the next image has already been received and it is determined that there is the next image to be consecutively processed, it is determined whether the setting of speed priority is disabled (T32).

If it is determined that the setting of speed priority is disabled, the sheet is once conveyed backward to pull the front end of the sheet back to the first standby position (T4) and then conveyed forward so that the front end of the sheet is in the second standby position (T8). In contrast, if it is determined that the setting of speed priority is enabled, the sheet is conveyed backward to move the front end of the sheet directly to the second standby position (T8). After that, printing of the next image is started (T9).

As described above, in the case where the setting of speed priority is disabled, the front end of the sheet is once pulled back to the first standby position to expose the whole area of the platen. Accordingly, ink mist that has occurred in the printing unit in the printing operation can be effectively collected from a suction opening of the platen. This can reduce the adhesion of ink mist to components in the printing apparatus, thereby preventing ink from being transferred to the sheet and increasing the longevity of the printing apparatus. On the other hand, in the case where the setting of speed priority is enabled, the front end 9 of the sheet is pulled back to the second standby position which is downstream of the first standby position in the conveying direction and is close to the printing unit. This can reduce a standby time for the start of printing of the next image and improve printing throughput.

OTHER EMBODIMENTS

In the present invention, it is only necessary to change a conveyance amount of the continuous sheet in the second direction based on the operation state of the printing apparatus after the cutting operation of the continuous sheet. In the embodiments described above, a change condition for changing the conveyance amount of the continuous sheet is whether the operating state of the printing apparatus is a printing operation, whether the suction operation of the continuous sheet is stopped, whether to perform an ink ejection state detection operation, or a time elapsed from the cutting operation to the next printing operation. However, the condition for changing the conveyance amount is not limited to such an operation state of the printing apparatus and may be arbitrary. Further, the change conditions may be combined. In the embodiments described above, the conveyance amount of the continuous sheet corresponding to each of the change conditions includes two types of amounts: a conveyance amount for locating the front end of the continuous sheet at the first standby position and a conveyance amount for locating the front end of the continuous sheet at the second standby position. However, the types of conveyance amounts of the continuous sheet may be different for each change condition. Further, three or more types of conveyance amounts may be used.

In the embodiments described above, a means to convey a sheet is the conveying roller. However, the means to convey a sheet is not limited to this and may be a conveying belt or the like. In this case, a time between an image printing operation and the next image printing operation can be reduced and printing throughput can be increased by changing a position to which a sheet is pulled back by the conveying means depending on the operation state of the printing apparatus after the sheet cutting operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-096005 filed May 12, 2017, which is hereby incorporated by reference herein in its entirety.

What is claimed is:

1. A printing apparatus comprising:

a printing unit configured to perform a printing operation for printing an image on a continuous sheet;

a platen configured to support the continuous sheet to be printed by the printing unit;

a suction unit configured to perform, in a case where the printing operation is performed, a suction operation for sucking the continuous sheet supported on the platen;

a conveying unit configured to convey the continuous sheet in a first direction, which is a conveyance direction in the printing operation, and a second direction opposite to the first direction;

a cutting unit provided downstream of the printing unit in the first direction and configured to perform a cutting operation for cutting the continuous sheet; and a control unit configured to cause the conveying unit to convey the continuous sheet in the second direction after the cutting operation so as to (i) in a case where the suction operation is stopped in a period from the cutting operation until a next printing operation, stop the continuous sheet at a first position where the continuous sheet does not face the printing unit, and (ii) in a case where the suction operation is continued after the cutting operation, stop the continuous sheet at a second position where the continuous sheet faces the printing unit.

2. The printing apparatus according to claim 1, wherein the conveying unit includes a conveying roller provided upstream of the printing unit with respect to the first direction and configured to convey the continuous sheet, and the control unit stops a front end of the continuous sheet between the conveying roller and the cutting unit in the second direction.

3. The printing apparatus according to claim 1, wherein the control unit stops a front end of the continuous sheet in the first position in a case where an operation after the cutting operation is a different operation from the printing operation, and stops the front end of the continuous sheet in the second position in a case where an operation after the cutting operation is the printing operation.

4. The printing apparatus according to claim 3, wherein the printing unit comprises a print head configured to print an image on the continuous sheet by ejecting ink, and the different operation from the printing operation includes a detection operation for detecting a state of ink ejection from the print head.

5. The printing apparatus according to claim 3, further comprising a replaceable ink tank which stores ink, wherein the printing unit comprises a print head configured to print an image on the continuous sheet by ejecting ink supplied from the ink tank, and the different operation from the printing operation includes a notification operation for urging replacement of the ink tank to compensate for a shortage of ink used by the printing unit.

6. The printing apparatus according to claim 1, wherein the control unit changes a conveyance amount of the continuous sheet in the second direction depending on an elapsed time from finishing the cutting operation to starting the next printing operation.

7. The printing apparatus according to claim 6, wherein the control unit stops a front end of the continuous sheet in a third position in a case where the elapsed time exceeds a predetermined time, and stops the front end of the continuous sheet in a fourth position downstream of the third position in the first direction in a case where the elapsed time is within the predetermined time.

8. The printing apparatus according to claim 1, wherein the printing unit comprises a print head configured to print an image on the continuous sheet by ejecting ink, the printing apparatus further comprises a detection unit configured to perform a detection operation for detecting a state of ink ejection from the print head, and the control unit changes a conveyance amount of the continuous sheet in the second direction depending on an operation state of the detection unit after the cutting operation.

9. The printing apparatus according to claim 8, wherein the control unit stops a front end of the continuous sheet in a third position in a case where the detection unit performs the detection operation after the cutting operation, and stops the front end of the continuous sheet in a fourth position downstream of the third position in the first direction in a case where the detection unit does not perform the detection operation after the cutting operation.

10. The printing apparatus according to claim 1, wherein the control unit changes a conveyance amount of the continuous sheet in the second direction depending on the type of continuous sheet.

11. The printing apparatus according to claim 1, wherein the control unit changes a conveyance amount of the continuous sheet in the second direction depending on a print mode set in the printing apparatus.

12. The printing apparatus according to claim 1, wherein, in the case where the suction operation is stopped in the period from the cutting operation unit the next printing operation, the suction unit stops the suction operation after the continuous sheet is stopped at the first position.

13. The printing apparatus according to claim 12, wherein, in the case where an operation not accompanied by the suction operation is performed after the suction operation stops, the control unit stops the continuous sheet at a position where a front end of the continuous sheet faces the printing unit.

* * * * *